US008535751B2

(12) United States Patent
Gillesberg

(10) Patent No.: US 8,535,751 B2
(45) Date of Patent: Sep. 17, 2013

(54) METHOD FOR COATING AN OBJECT

(75) Inventor: Bo Gillesberg, Augustenborg (DK)

(73) Assignee: Tantaline A/S, Nordborg (DK)

( * ) Notice: Subject to any disclaimer, the term of this patent is extended or adjusted under 35 U.S.C. 154(b) by 967 days.

(21) Appl. No.: 11/814,484

(22) PCT Filed: Jan. 24, 2006

(86) PCT No.: PCT/DK2006/000039

§ 371 (c)(1),
(2), (4) Date: Apr. 25, 2008

(87) PCT Pub. No.: WO2006/076924

PCT Pub. Date: Jul. 27, 2006

(65) Prior Publication Data

US 2009/0125109 A1 May 14, 2009

(30) Foreign Application Priority Data

Jan. 24, 2005 (DK) ..... 2005 00118

(51) Int. Cl.

| | |
|---|---|
| ***C25D 5/00*** | (2006.01) |
| ***C25D 17/06*** | (2006.01) |
| ***A61F 2/28*** | (2006.01) |
| ***B05D 5/00*** | (2006.01) |

(52) U.S. Cl.
USPC ..... 427/2.26; 623/11.11; 623/16.11

(58) Field of Classification Search
USPC ..... 427/2.26; 623/11.11, 16.11
See application file for complete search history.

(56) References Cited

U.S. PATENT DOCUMENTS

| | | | | |
|---|---|---|---|---|
| 4,472,476 | A | 9/1984 | Veltri et al. | |
| 4,534,130 | A * | 8/1985 | Rogers | 47/65.5 |
| 4,558,388 | A | 12/1985 | Graves, Jr. | |
| 4,752,503 | A | 6/1988 | Thebault | |
| 4,823,734 | A | 4/1989 | Christin | |
| 4,908,982 | A * | 3/1990 | Quatrini | 47/39 |
| 5,049,074 | A * | 9/1991 | Otani et al. | 433/173 |
| 5,576,058 | A | 11/1996 | Norrgrann et al. | |
| 6,231,923 | B1 | 5/2001 | Teverovsky et al. | |
| 6,464,912 | B1 * | 10/2002 | Goela et al. | 264/81 |
| 6,875,277 | B1 | 4/2005 | Edgerton | |
| 6,926,925 | B2 * | 8/2005 | Thebault et al. | 427/248.1 |
| 2003/0190420 | A1 | 10/2003 | Chappa et al. | |
| 2004/0261912 | A1 * | 12/2004 | Wu | 148/421 |

FOREIGN PATENT DOCUMENTS

| | | | |
|---|---|---|---|
| EP | 0569117 | A | 11/1993 |
| WO | 03040429 | A | 5/2003 |

OTHER PUBLICATIONS

PCT International Search Report for PCT/DK2006/000039 dated Mar. 14, 2006.
Danish Search Report for Application No. PA 2005 00118 dated Aug. 16, 2005.

* cited by examiner

*Primary Examiner* — Kriellion Sanders
(74) *Attorney, Agent, or Firm* — McCormick, Paulding & Huber LLP

(57) ABSTRACT

A method for coating an object (1). The object (1) is positioned in contact with holding means and the coating (4) is applied in such a way that contact parts (3, 8, 10) of the holding means form part of the coating (4). Contact parts (3, 8, 10) are made from a material having corrosion properties being substantially identical to the corrosion properties of the coating material, preferably from the same material. Thereby the contact parts (3) can form a natural part of the resulting coating (4). The contact parts (3, 8, 10) may subsequently be detached from the holding means and remain attached to the object (1) as part of the coating (4). Provides a substantially full coating (4) to the object (1) in one coating step. Avoids or reduces problems relating to pinholes in coatings. Further an object (1) having a coating (4) which has been provided using the method.

20 Claims, 3 Drawing Sheets

METHOD FOR COATING AN OBJECT

CROSS REFERENCE TO RELATED APPLICATIONS

This application is entitled to the benefit of and incorporates by reference essential subject matter disclosed in International Patent Application No. PCT/DK2006/000039 filed on Jan. 24, 2006 and Danish Patent Application No. PA 2005-00118 filed Jan. 24, 2005.

FIELD OF THE INVENTION

The present invention relates to a method for coating an object in such a manner that a very tight coating is obtained. Furthermore the present invention relates to an object having a coating which has been applied by means of the method.

BACKGROUND OF THE INVENTION

It is often desirable to apply a coating to an object. This may, e.g., be in order to obtain a surface having specific properties, e.g. in terms of resistance to corrosions, colour, absorbance/reflectance of electromagnetic waves at certain wavelengths, surface texture, e.g. roughness, electrical conductivity, biocompatibility, etc.

In prior art coating techniques the object to be coated is typically attached to or positioned on a holder while the coating is performed. The holder may be of the kind which supports a lower part of the object, i.e. the object rests on the holder. Alternatively the holder may comprise wires which are attached to the object in such a way that the object will be hanging from the wires during the coating process. Alternatively or additionally, the holder may comprise one or more rods or arms from where the object may be hanging during the coating process. After the coating process the object is removed from the holder, thereby leaving small holes (pinholes) in the coating. The pinholes may even contain remains of the holder which is typically made from a different material than the coating material. Due to the pinholes the coated surface is imperfect. Thus, a pinhole may provide a position where corroding substances may gain access to the underlying object, thereby drastically decreasing the corrosive resistant properties of the coated surface. This is extremely disadvantageous and may reduce the lifetime of the object considerably, and it may even make the object unsuitable for some applications, such as artificial internal body parts (e.g. artificial bones) for implantation. Furthermore, other desirable surface properties may not be obtained by the coated object when the coating comprises pinholes.

It has previously been attempted to reduce the disadvantages introduced by the pinholes. Thus, after the initial coating process the object may be removed from the holder, rotated and repositioned on the holder (or on another holder) in such a way that the new contact points between the holder and the object do not coincide with the contact points between the holder and the object during the first coating process. A second coating process is subsequently performed, the second coating process ensuring that the pinholes are covered with coating material. Using this approach there is, however, a risk that new pinholes appear when the object is removed from the holder following the second coating process. Furthermore, there is a risk that the original pinholes are not properly covered during the second coating process. For instance, the contact points from each of the coating processes will at most be covered by a coating having a thickness which is smaller than the thickness of the coating of the remaining part of the object. The disadvantages of the presence of these pinholes may therefore not be avoided.

Furthermore, the total contact area between the holder and the object is kept at a minimum in prior art coating techniques, thereby reducing the size and the number of the pinholes as much as possible. This may, e.g., be obtained by positioning the object on narrow spikes of the holder. However, in case of electrochemical coating techniques it is not possible to reduce the size of the contact points indefinitely. When the area of a contact point is reduced below a certain lower limit the electrical resistance in that area becomes so large that the material present in the area is heated considerably. Thereby the coating may be damaged or even destroyed. Furthermore, it may be a problem to draw a sufficiently strong current to perform the coating process, due to the large electrical resistance.

None of the prior art solutions described above provide a coated surface where the coating is homogeneously applied over the complete surface of the object. Furthermore, it is a disadvantage that the coating has to be applied in two or more coating steps in order to provide a substantially tight coating since this makes the coating process cumbersome. Furthermore, each coating of an object takes longer than it would if only one coating step was needed, the throughput thereby being considerably reduced. Finally, the manufacturing costs of the object are relatively high.

SUMMARY OF THE INVENTION

It is, thus, an object of the present invention to provide a method for coating an object in such a way that an at least substantially tight coating is obtained in one coating step.

It is a further object of the present invention to provide a method for coating an object in such a manner that a coated surface having an improved resistance to corrosions is obtained.

It is an even further object of the present invention to provide a method for coating an object in such a way that pinholes are at least substantially avoided.

It is an even further object of the present invention to provide a method for coating an object in which the total throughput is increased as compared to prior art coating methods.

It is an even further object of the present invention to provide a method for coating an object in a cost efficient manner.

It is an even further object of the present invention to provide an object which is suitable for use as an implant.

It is an even further object of the present invention to provide an object which is suitable for use in an environment of corrosion class C3 or more aggressive according to ISO 9223 standard.

According to a first aspect of the present invention the above and other objects are fulfilled by providing a method for coating an object, the method comprising the steps of:

- providing holding means for holding the object during coating, the holding means comprising one or more parts being in contact with the object during coating,
- positioning the object in contact with the holding means,
- providing a coating to the object in such a way that the contact part(s) form(s) part of the coating, wherein at least the contact part(s) of the holding means is/are manufactured from a material having corrosion properties being at least substantially identical to the corrosion properties of the coating material.

The contact part(s) form(s) part of the holding means and define(s) one or more contact points between the holding means and the object. Thus, the contact part(s) may form an integral part of the holding means, i.e. it may be the part of the holding means which is actually holding the object during the coating. This will be described in further detail below. However, the contact part(s) need(s) not form an integral form of the holding means. Alternatively, the contact part(s) may form one or more separate parts, or it/they may form an integral part of the object. For example, the contact part(s) may be in the form of one or more wires which are attached to the object which is subsequently positioned on the holding means in such a way that the holding means only touches the object in areas where the wire(s) is/are attached. Thereby the contact part(s) define(s) one or more contact points between the holding means and the object.

The coating is provided in such a way that the contact part(s) form(s) part of the coating. This may, e.g., be achieved by applying the coating in the area(s) around the contact part(s) in a tight manner, i.e. in such a way that the coating material completely surrounds the contact part(s) without leaving pinholes or the like. One way of doing this is to ensure that the coating material is capable of adhering to the material of the contact part(s) as well as to the material of the object. Alternatively, the coating material and the material of the contact part(s) may undergo a chemical reaction during the coating process, thereby forming an alloy in at least part of the area covered by the contact part(s). Since the coating around the contact part(s) is tight and since the contact part(s) form(s) part of the coating, the resulting coating is completely tight, i.e. no pinholes appear. Thereby a very tight coating has been provided in just one coating step. As described above, an object having such a coating will be much more resistant to corrosions, even in relatively aggressive environments, such as an environment of corrosion class C3 or more aggressive according to ISO 9223 standard. The object will thereby be very suitable for use as an implant, e.g. an artificial bone, for use in an aggressive environment, etc.

It is important that the corrosion properties of the material of the contact part(s) are at least substantially identical to the corrosion properties of the coating material. Thereby the resulting coating will have at least substantially uniform corrosive properties throughout the entire surface of the object. This, in turn, results in the final coated object being relatively resistant to corrosion, i.e. no pinholes or similar areas where corrosive substances may gain access to the uncoated surface of the object. In the present context the term 'substantially identical corrosion properties' should be understood as substantially identical corrosion properties in the environment of intended use, e.g. in terms of chemical substances surrounding the final object, physical conditions, e.g. wear and tear, energetic influences, such as temperature, radiation, etc., or other conditions which may change the corrosion properties of a material.

Furthermore, the tight and substantially uniform coating has been applied in just one coating step. Thus, at least one further process step has been avoided as compared to prior art coating techniques, thereby providing a coating method which is easier and more cost efficient to perform.

The method may further comprise the step of:

detaching the coated object from the holding means in such a way that at least the contact part(s) subsequently form(s) part of the object, the contact part(s) thereby being detached from the rest of the holding means.

In this embodiment the holding means is detached from the object in such a way that the contact part(s) remain(s) attached to the object as a part of the coating.

The detaching may, e.g., be performed by breaking or cutting off a part of the holding means. Alternatively, e.g. in case the contact part(s) initially form(s) part of the object, the detaching may simply be performed by moving the object, including the contact part(s) away from the holding means. After the detaching step additional material may be removed in the area(s) of the contact part(s) in order to obtain a coating having a more even thickness. This may be done by using a suitable procedure, e.g. a physical or mechanical procedure, such as grinding, a chemical procedure, such as etching, a thermal procedure, such as evaporation or melting procedures, and/or any other suitable kind of procedure.

Alternatively, the holding means as well as the object may simply be removed from the process equipment, i.e. no detaching takes place. In this case the object may be detached from the holding means at a later point, e.g. by an end user immediately before the object is taken into use.

In a preferred embodiment at least the contact part(s) of the holding means is/are manufactured from the same material as the coating material. In this embodiment the contact part(s), after the coating step, and optionally after having been detached from the remaining part of the holding means, will in a very natural manner form part of the coating, and the resulting object will have a coating of one material covering the whole of the surface of the object. Thereby a very homogeneous coating has been provided in just one coating step.

The contact part(s) of the holding means may comprise at least one wire or the like. In this embodiment the wire(s) is/are attached to the object prior to the coating process, and during the coating process the object is hanging from the wire(s). The wire(s) may be designed from a solid material, e.g. from thread, rod, bar, band, foil etc., or from non-solid or porous materials, e.g. tube, woven, foamed or filtered material etc. The wire material may be applied in plan or machined form, e.g. bended, twisted, threaded, drawn etc.

Furthermore, the step of positioning the object may, in this case, comprise drilling at least one hole in the object and positioning the wire(s) in said hole(s), and the step of providing a coating may comprise filling gaps between the wire(s) and inner walls of the hole(s) with the coating material. In this embodiment the object comprises one or more holes corresponding to the number of wires of the holding means. The wires are attached to the object via the hole(s). The hole(s) may be in the form of 'blind' hole(s), or it/they may be in the form of through-going bore(s). The hole(s) may be threaded in which case the wire(s) may be screwed into the hole(s). When a wire is positioned in a corresponding hole a gap is preferably defined between the wire and the walls of the hole. During the subsequent coating process this gap, or at least the part of the gap being near the surface of the object, will be filled with coating material, thereby ensuring that the coating around the wire is sufficiently tight, i.e. there will be no access to the surface of the object after the coating process has been performed. In this case the distance between the wire and the walls of the hole should be smaller than twice the thickness of the coating after the coating process. Thereby it is ensured that the gap is completely filled with the coating material.

Alternatively, the contact part(s) of the holding means may comprise at least one spike being adapted to support a lower part of the object. In this case the object rests on these spikes during the coating process.

Alternatively, the contact part(s) may be of any other suitable kind. In case the object to be coated is a relatively large object, such as process equipment, e.g. a chemical reactor, it may be desirable to use relatively robust holding means, e.g. comprising one or more tubes and/or one or more rods. In this case the holding means may comprise a multilayered structure, e.g. a coated structure, having an outer layer with the desired corrosion properties (e.g. a steel wire with a tantalum coating). In this case at least part of this outer layer may form the contact part(s) of the holding means, i.e. a contact area is defined between the outer layer of the multilayered structure and the object. After coating the object the multilayered structure will typically be broken or cut off in such a way that at least part of the outer layer of the multilayered structure forms part of the coating of the object. In case the multilayered structure is broken or cut off in such a way that 'non-outer layer' parts of the multilayered structure are attached to the object, these parts may subsequently be removed, e.g. as described above. However, in this example it would be advantageous to remove such parts by means of etching because such parts will typically have corrosion properties being substantially different from the corrosion properties of the coated object.

The step of positioning the object may comprise welding the contact part(s) of the holding means onto the object. In case the contact part(s) comprise(s) one or more wires to be positioned in one or more corresponding holes in the object as described above, the wire(s) may be welded into the holes. Alternatively, one or more wires may be welded directly onto one or more surfaces of the object. Furthermore, in case the contact part(s) comprise(s) one or more spikes, these may also be welded directly onto the object in order to ensure that the object does not move during the coating process regardless of the shape of the object. It should be noted that when the contact part(s) is/are welded onto the object the coated object will have a 'bulb' in the area around the position(s) of the contact part(s). Thus, such an object may be recognisable.

Alternatively, the step of positioning the object may comprise soldering the contact part(s) of the holding means onto the object. The remarks set forth above apply equally in this case.

Alternatively, the step of positioning the object may be performed in any other suitable manner, e.g. mechanically, such as using screws, bolts and/or flexible bands, thermally, such as by means of welding and/or using the thermal expansion coefficients of various materials, chemically, such as using glue, frictionally or energetically, such as using magnetism, etc. As long as the object is positioned in a manner which keeps the object stable during the coating process it is of minor importance how the object was positioned.

The coating material is preferably a metal or an alloy. Thus, in a preferred embodiment the coating material is tantalum or an alloy of tantalum. Since tantalum is very resistant to corrosions, a coating of tantalum or an alloy of tantalum which has been applied in accordance with the present invention will efficiently protect the object from corrosion. Furthermore, it is well known that tantalum is a tissue compatible material, and an object having a tight coating of tantalum or an alloy of tantalum is therefore very suitable for use as an implant.

Alternatively, the coating material may be platinum, niobium, tungsten, gold, titanium, chromium, cobalt or molybdenum, or it may be an alloy of any of these materials. Alternatively, the coating material may be any other suitable kind of metal or alloy. Typically, the coating material is chosen among materials having a corrosion rate lower than steel in the environment where it is intended to use the resulting object.

Alternatively, the coating material may be any other suitable kind of material. For example, the contact part(s) may be one or more nylon cords or wires, and the coating material may be an epoxy material.

The object may be manufactured from one or more metals and/or one or more alloys. Thus, the object may, e.g., be manufacture from any of the materials mentioned above.

According to a second aspect of the present invention the above and other objects are fulfilled by providing an object having a coating which has been provided using the method according to the first aspect of the present invention.

It should be noted that any feature which has been described in combination with the first aspect of the present invention may equally be combined with the second aspect of the present invention, and vice versa.

The object may be adapted to be implanted into the body of a mammal. The mammal may advantageously be a human being, but it may alternatively be another mammal, e.g. a pet, such as a dog, a cat, a horse, etc. Thus, the object may be or form part of an artificial bone structure, such as an artificial hip, an artificial knee, or any other suitable kind of bone structure. The object may be or form part of a part which is suitable for being positioned in or adjacent to body tissue or fluids, such as inner organs, muscles, fat, skin, blood, saliva, etc. Alternatively, the object may be or form part of an artificial tooth. As mentioned above, an object which has been coated in accordance with the method of the present invention is very suitable for use as an implant because the substantially full coating offers improved biocompatibility due to the good corrosion properties.

The object may be or form part of a structure which is subject to a risk of corrosion. As described above, such an object may be an implant. Alternatively, such an object may be a capacitor, e.g. a tantalum or niobium based capacitor. In this case a substantially full coating offers improved corrosion properties when the capacitor is in contact with an electrolyte. Alternatively, the object may be or form part of an electrode in which case a current is running through the object and the coating. In this case the substantially full coating reduces the risk of selective corrosion of the object. Alternatively, the object may be or form part of chemical process equipment or measuring equipment, e.g. temperature measuring equipment, which is adapted to be used in a relatively hostile environment. In this case the substantially full coating reduces the risk of corrosion of the object when in contact with one or more chemical substances. Alternatively, the object may be or form part of equipment which is adapted to be in contact with chemical substances, e.g. transportation, regulation, production, processing or storage equipment for such substances. As mentioned above, the substantially full coating reduces the risk of corrosion of the object due to the contact with the chemical substances. Thus, in this case the coating preferably has the function of preventing corrosive substances from gaining access to the surface of the object.

Alternatively or additionally, the object may be or form part of a structure which is subject to a risk of chemical contamination. Such an object may, e.g., be or form part of furnace equipment. If, for instance, the furnace equipment is to be used for heat treatment of tantalum objects it may be important that the objects are not contaminated by the furnace equipment. This may be avoided by providing the furnace equipment with a tight coating of tantalum. Alternatively, the object may be or form part of capacitor manufacturing equipment. In this case the substantially full coating reduces the risk of contamination of the manufactured capacitors. Thus, in this case the coating preferably has the function of preventing substances or material from the object from leaving the object, thereby causing contamination of one or more items positioned in the vicinity of the object.

BRIEF DESCRIPTION OF THE DRAWINGS

The invention will now be further described with reference to the accompanying drawings, in which.

DETAILED DESCRIPTION OF THE INVENTION

Figure 1A:
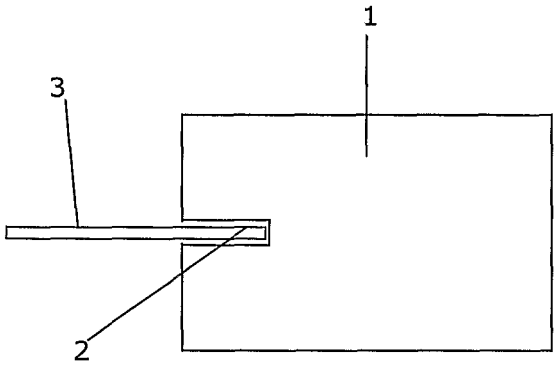
FIG. 1*a* shows an object and a contact part in the form of a wire positioned in a hole in the object.

FIG. 1*a* shows a cross section through an object 1 having a hole 2 formed therein. A wire 3 may be positioned in the hole 2. The wire 3 is or forms part of a contact part of a holder. Thus, the end of the wire 3 which is opposite to the end which is positioned in the hole 2 may be fixed to an inner wall of an at least substantially closed chamber in which the coating takes place. Thereby the object 1 will be hanging in the chamber during the coating process.

Figure 1B:
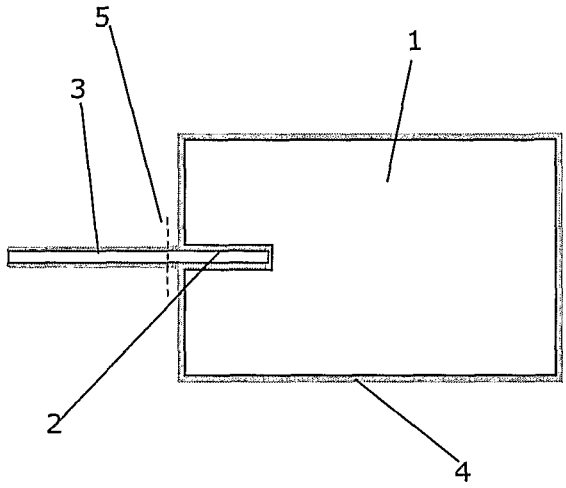
FIG. 1*b* shows the object of FIG. 1*a* with a coating applied.

FIG. 1*b* shows the object 1 of FIG. 1*a*. However, in FIG. 1*b* the object 1 has been provided with a coating 4. As can be seen the coating material completely fills the hole 2. The coating material further covers the wire 3. Thereby the wire 3 forms part of the coating 4, and the coating 4 thereby covers the whole of the surface of the object 1. The wire 3 is made from a material which has at least substantially identical corrosion properties as the coating material. Thereby the resulting coating 4 will have at least substantially uniform corrosion resistant properties throughout the surface of the coated object 1. After the coating 4 has been applied the wire 3 may be cut or broken so that the protrusion on the coated surface due to the wire 3 is decreased. This is illustrated by the broken line 5. Thus, the object 1 has been provided with a substantially full coating 4 in just one coating step.

Figure 2A:
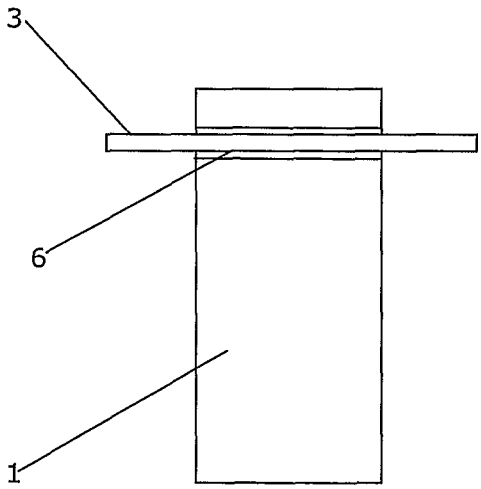
FIG. 2*a* shows an object and a contact part in the form of a wire positioned in a through-going bore in the object.

FIG. 2*a* shows a cross section through an object 1 having a through-going bore 6 formed therein. A wire 3 is positioned in the through-going bore 6, and the wire 3 is or forms part of a contact part of a holder. This is very similar to the situation described above with reference to FIG. 1*a*, and the remarks set forth in that connection are equally applicable here.

Figure 2B:
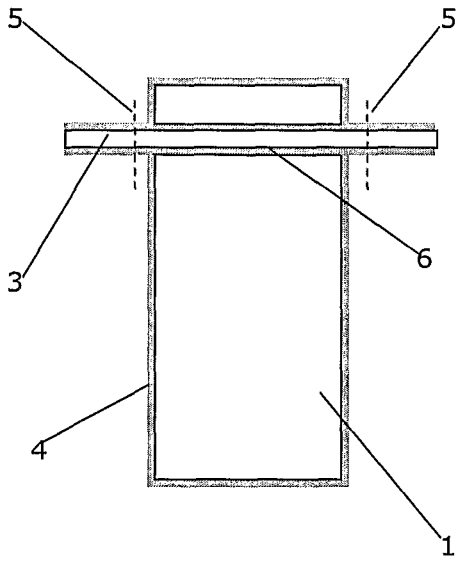
FIG. 2*b* shows the object of FIG. 2*a* with a coating applied.

FIG. 2*b* shows the object of FIG. 2*a*, but being provided with a coating 4. As can be seen the coating material completely fills the through-going bore 6, and it also covers the wire 3. Thereby the wire 3 forms part of the coating 4, and the coating 4 thereby covers the whole of the surface of the object 1. Alternatively, the coating material may only fill the part of the through-going bore 6 which is closest to the surface of the object 1, thereby leaving one or more 'air bubbles' in the through-going bore 6. A tight coating 4 will, however, still be obtained in this case because the part of the through-going bore 6 being closest to the surface of the object 1 is filled with coating material. As described above the wire 3 is made from a material having corrosion properties being at least substantially identical to the corrosion properties of the coating material, and the remarks set forth above in this regard are equally applicable here. As described above with reference to FIG. 1*b*, the wire 3 may subsequently be cut or broken so as to detach the object 1 (including the contact parts of the wire 3) from the remaining part of the holder. This is illustrated by the broken lines 5.

Figure 3A:
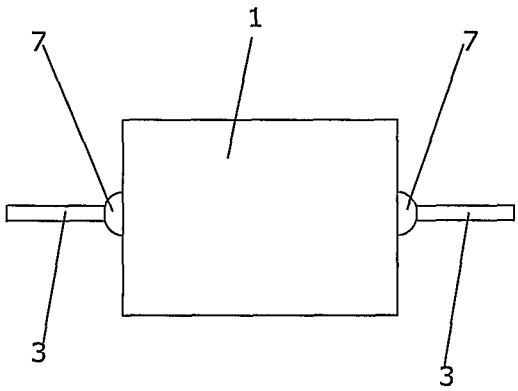
FIG. 3*a* shows an object and contact parts in the form of wires which have been welded onto the object.

FIG. 3*a* shows a cross section through an object 1. Two wires 3 have been welded onto outer parts of the object 1. The welding has caused bulbs 7 of welding material in the areas where the wires 3 have been attached. As described with reference to FIGS. 1*a* and 2*a* the wires 3 are or form part of the contact parts of a holder. The remarks set forth above in this regard are equally applicable here.

Figure 3B:
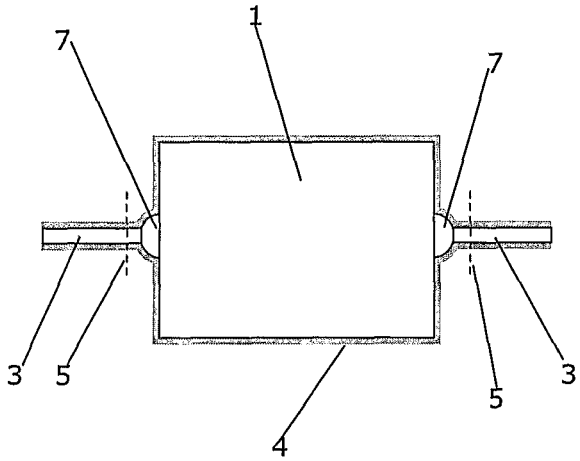
FIG. 3*b* shows the object of FIG. 3*a* with a coating applied.

FIG. 3*b* shows the object of FIG. 3*a*, but with a coating 4 applied thereto. As can be seen the coating material covers the bulbs 7 and the wires 3, and the wires 3 consequently form part of the coating 4. As described above with reference to FIGS. 1*b* and 2*b* the wires 3 are made from a material having corrosion properties being at least substantially identical to the corrosion properties of the coating material, and the remarks set forth above in this regard are equally applicable here. As described above with reference to FIGS. 1*b* and 2*b* the wires 3 may subsequently be cut or broken as indicated by the broken lines 5.

Figure 4A:
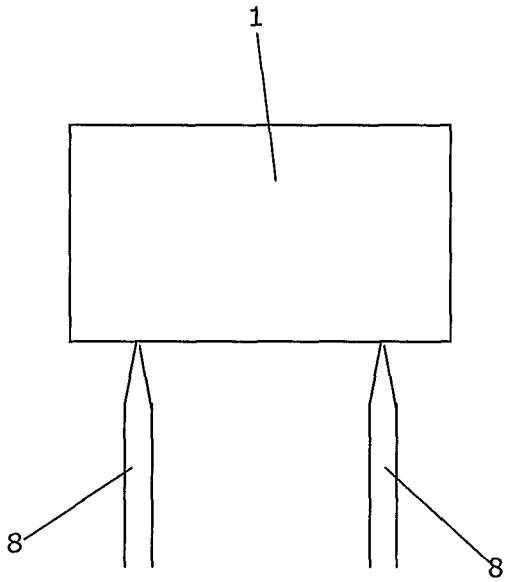
FIG. 4*a* shows an object and contact parts in the form of spikes supporting a lower part of the object.

FIG. 4*a* shows a cross section through an object 1 resting on a pair of spikes 8. The spikes 8 are or form part of a contact part of a holder. Thus, the spikes 8 may in turn rest on a holder, or they may rest directly on a floor part of the coating equipment.

Figure 4B:
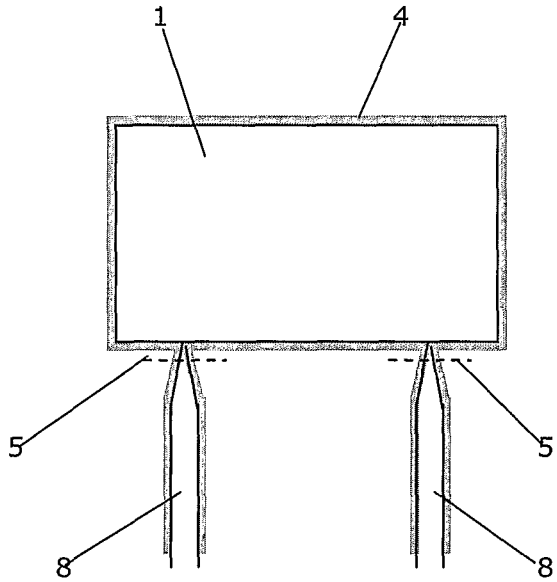
FIG. 4*b* shows the object of FIG. 4*a* with a coating applied.

FIG. 4*b* shows the object 1 of FIG. 4*a*, but having a coating 4 applied thereto. As can be seen, the coating material completely covers the spikes 8. Thereby the spikes 8 form part of the coating 4. The spikes 8 are made from a material having corrosion properties being at least substantially identical to the corrosion properties of the coating material. Thereby the resulting coated object 1 will have at least substantially uniform corrosion resistant properties throughout the surface of the coated object 1. The spikes 8 may subsequently cut or broken off, thereby detaching the spikes 8 (or at least part of the spikes 8) from the remaining part of the holder. This is illustrated by the broken lines 5.

Figure 5A:
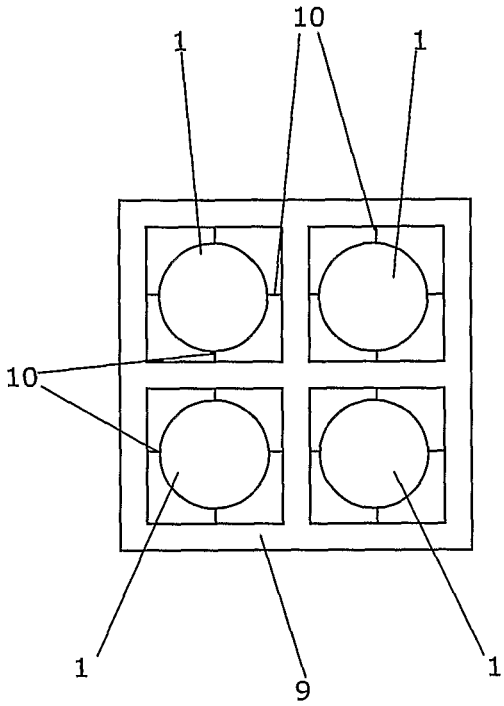
FIG. 5*a* shows four objects positioned in a holder.

FIG. 5*a* shows a cross section through four objects 1 positioned in a holder 9. Each of the objects 1 is attached to the holder 9 by means of four contact parts 10. The holder 9 and the four objects 1 may be positioned in appropriate coating equipment, e.g. a substantially tight chamber. This may be done in a known manner, as long as it is ensured that any contact points between the holder 9/object 1 part and the equipment are located on the holder 9. Thereby pinholes on the objects 1 will be avoided while pinholes may occur on the holder 9. This is, however, not critical because the objects 1 will typically be removed from the holder 9 before they are taken into use, and the resulting objects 1 will, thus, be pinhole free.

Figure 5B:
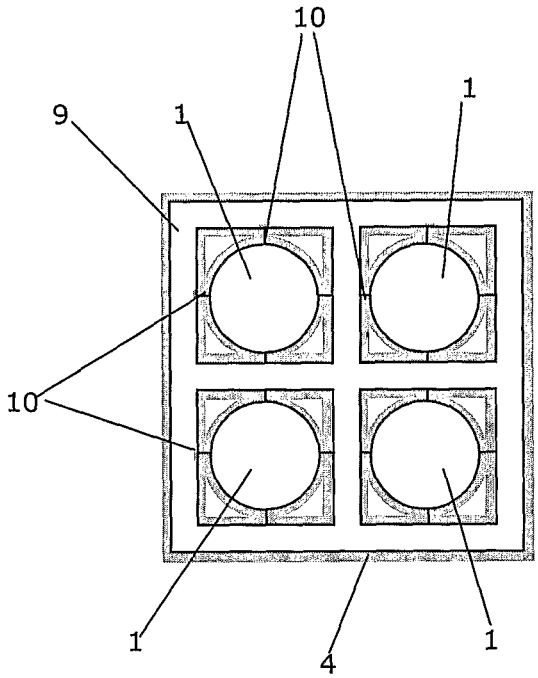
FIG. 5*b* shows the objects of FIG. 5*a* with a coating applied.

FIG. 5*b* shows the objects 1 and holder 9 of FIG. 5*a*, but with a coating 4 applied thereto. As can be seen, the coating 4 covers the outer parts of the objects 1, the holder 9 and the contact parts 10. The contact parts 10 thereby form part of the coating 4. The contact parts 10 are made from a material having corrosion properties being at least substantially identical to the corrosion properties of the coating material. The objects 1 may be delivered to an end user in the form shown in the Figure, i.e. the four objects 1 still being attached to the holder 9 via the contact parts 10. However, before the end user takes the objects 9 into use these should be removed from the holder 9. This may advantageously be done by breaking or cutting the contact parts 10 in such a way that at least part of them remains on the objects 1 as part of the coating 4. Thereby, the objects 1 have been provided with a tight coating 4 being relatively resistant to corrosion.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for coating an object, the method comprising the steps of:

providing holding means for holding the object during coating, the holding means comprising one or more contact parts being in contact with the object during coating;

positioning the object in contact with the holding means by attaching the contact part(s) to the object so that the object is hanging from the holding means; and providing a coating to the object and around the contact part(s) in such a way that the contact part(s) and the coating together cover the object;

wherein at least the contact part(s) of the holding means is/are manufactured from a material having corrosion properties being at least substantially identical to the corrosion properties of the coating material.

2. The method according to claim 1, further comprising the step of:

detaching the coated object from the holding means in such a way that at least the contact part(s) subsequently form (s) part of the object , the contact part(s) thereby being detached from the rest of the holding means.

3. The method according to claim 1, wherein at least the contact part(s) of the holding means is/are manufactured from the same material as the coating material.

4. The method according to claim 1, wherein the contact part(s) of the holding means comprise(s) at least one wire.

5. The method according to claim 4, wherein the step of positioning the object comprises drilling at least one hole in the object and positioning the wire(s) in said hole(s), and wherein the step of providing a coating comprises filling gaps between the wire(s) and inner walls of the hole(s) with the coating material.

6. The method according to claim 1, wherein the contact part(s) of the holding means comprise(s) at least one spike being adapted to support a lower part of the object.

7. A coated object, comprising:

a holding means comprising one or more contact parts that are attached to the object, such that the object hangs from the holding means; and a coating material covering the surface of the object and around the contact part(s) of the holding means such that the contact part(s) and the coating together cover the object;

wherein the contact part(s) of the holding means is/are manufactured from a material having corrosion properties substantially identical to the corrosion properties of the coating material.

8. The method according to claim 1, wherein the step of positioning the object comprises soldering the contact part(s) of the holding means onto the object.

9. The method according to claim 1, wherein the coating material is a metal or an alloy.

10. The method according to claim 9, wherein the coating material is tantalum or an alloy of tantalum.

11. The method according to claim 1, wherein the object is manufactured from one or more metals and/or one or more alloys.

12. The object according to claim 7, wherein the object is adapted to be implanted into the body of a mammal.

13. The object according to claim 12, wherein the object is or forms part of an artificial bone structure.

14. The object according to claim 12, wherein the object is or forms part of an artificial tooth.

15. The object according to claim 7, wherein the object is or forms part of a structure which is subject to a risk of corrosion.

16. The object according to claim 7, wherein the object is or forms part of a structure which is subject to a risk of chemical contamination.

17. The method according to claim 1, wherein the step of positioning the object comprises welding the contact part(s) of the holding means onto the object.

18. The method according to claim 1, wherein the coating and the contact part(s) of the holding means together provide a full coating to the object without pinholes.

19. The method according to claim 1, wherein the contact part(s) of the holding means are made from the same material as the coating.

20. The object according to claim 7, wherein the coating and the contact part(s) of the holding means together provide a full coating to the object without pinholes.

* * * * *